US007963083B1

(12) United States Patent
Briggs et al.

(10) Patent No.: US 7,963,083 B1
(45) Date of Patent: Jun. 21, 2011

(54) SYSTEM AND PROCESS FOR INSTALLING STANDING SEAM ROOFS

(75) Inventors: Earl Benton Briggs, Fort Gibson, OK (US); Doss Briggs, legal representative, Fort Gibson, OK (US); Dean Barkley Briggs, Fort Gibson, OK (US); Shahn David Corter, Tecumseh, OK (US)

(73) Assignee: Briggs Rainbow Buildings, Inc., Fort Gibson, OK (US)

( * ) Notice: Subject to any disclaimer, the term of this patent is extended or adjusted under 35 U.S.C. 154(b) by 0 days.

(21) Appl. No.: 12/643,445

(22) Filed: Dec. 21, 2009

Related U.S. Application Data

(63) Continuation-in-part of application No. 11/675,293, filed on Feb. 15, 2007, now Pat. No. 7,634,882.

(51) Int. Cl.
*E04D 1/34* (2006.01)

(52) U.S. Cl. ..... 52/520; 52/489.1; 52/545

(58) Field of Classification Search ..... 52/520, 52/545, 466, 478, 489.1, 463, 454, 582.1, 52/547

See application file for complete search history.

(56) References Cited

U.S. PATENT DOCUMENTS

| | | | | |
|---|---|---|---|---|
| 236,755 | A | | 1/1881 | Banks |
| 1,292,960 | A | | 1/1919 | Owens |
| 1,900,721 | A | | 3/1933 | Manske et al. |
| 1,946,694 | A | | 2/1934 | Hunter |
| 2,934,180 | A | | 4/1960 | Hammitt et al. |
| 4,007,919 | A | | 2/1977 | Totten |
| 4,010,589 | A | | 3/1977 | Gross |
| 4,361,998 | A | * | 12/1982 | Ellison et al. ..... 52/520 |
| 4,476,658 | A | | 10/1984 | Johnstone |
| 4,514,952 | A | | 5/1985 | Johansson |
| 4,570,404 | A | | 2/1986 | Knudson |
| 4,597,234 | A | | 7/1986 | Simpson |
| 4,741,142 | A | | 5/1988 | Otto et al. |
| 4,987,716 | A | | 1/1991 | Boyd |
| 5,001,881 | A | | 3/1991 | Boyd |
| RE33,566 | E | | 4/1991 | Heckelsberg |
| 5,134,825 | A | | 8/1992 | Berridge |
| 5,150,885 | A | | 9/1992 | Leone |
| 5,259,166 | A | | 11/1993 | Carey, II et al. |
| 5,697,197 | A | | 12/1997 | Simpson |
| 5,715,640 | A | | 2/1998 | Haddock |
| 5,911,663 | A | | 6/1999 | Eidson |
| 6,536,729 | B1 | | 3/2003 | Haddock |
| 6,775,951 | B2 | | 8/2004 | Gumpert et al. |
| 6,904,730 | B2 | | 6/2005 | Mitchell |
| 7,021,023 | B2 | | 4/2006 | Rood, Jr. |
| 7,634,882 | B1 | | 12/2009 | Briggs et al. |
| 2005/0055904 | A1 | | 3/2005 | Greenberg |

* cited by examiner

*Primary Examiner* — Robert J Canfield
*Assistant Examiner* — Christine T Cajilig
(74) *Attorney, Agent, or Firm* — Head, Johnson & Kachigian, P.C.

(57) ABSTRACT

A standing seam roof assembly. The assembly includes at least one first panel with a first side edge turned vertically upward. At least one second panel has a side edge turned vertically upward with the second panel side edge adjoining the first panel side edge. A plurality of clips each have a fixed base with a slot therethrough. At least one base insert has a substantially flat first section installable beneath the first panel, a substantially flat second section installable beneath the second panel, and a plurality of upturned tabs between the first and the second side edge. The upturned tabs are received in the slots of the clips. Adhesive on the first section adheres to the first panel and adhesive on the second section adheres to the second panel.

10 Claims, 5 Drawing Sheets

SYSTEM AND PROCESS FOR INSTALLING STANDING SEAM ROOFS

CROSS-REFERENCE TO RELATED APPLICATION

This application is a continuation-in-part of application Ser. No. 11/675,293 filed Feb. 15, 2007 titled "System and Process for Installing Standing Seam Roofs." The parent application is incorporated by reference herein as if reproduced in full below.

BACKGROUND OF THE INVENTION

1. Field of the Invention

The present invention relates to both a system and a process for standing seam metal roofs. In particular, the present invention is directed to a system and a process for installing standing seam roofs which will resist failure from wind and other forces.

2. Prior Art

Standing seam roofs are well known and are used today in industrial, commercial, and even residential construction and repair applications.

Standing seam roofs consist of a series of elongated panels. The panels may be flat metal panels, may be corrugated, or of other design. The panels typically have a pair of opposite side edges, with each side edge turned up approximately 90° away from the roof. The adjoining metal panels terminate in upward edges which are then joined together to form a seal. The edges are then turned over or crimped, such as with a mechanical tool, so that the panels are joined together and sealed.

The roof panels are secured to the purlins, beams, or other building structure in a number of ways. In one typical implementation, clips are periodically secured along an edge of a metal panel to the purlins.

In some applications, adhesive is used between the panels to assist in securing the panels together. However, wind forces may still tend to lift the panels, causing potential failure of the seal in the seam.

Various other roof connecting and sealing mechanisms have been employed in the past.

Mitchell (U.S. Pat. No. 6,904,730) discloses a long continuous clip formed from an L-shaped sheet in FIG. 1 with an alternate configuration shown in FIG. 5.

Greenberg (U.S. Patent Application Publication No. 2005/0055904) discloses a standing seam roof with an anchor 20 having a securing portion and a mating portion 24.

Knudson (U.S. Pat. No. 4,570,404) discloses a hold down strip 15 held down by a fastener with upstanding portion 32.

Simpson (U.S. Pat. No. 4,597,234) discloses roof panels 26 secured by angle iron clips 52 fastened to the roof.

Berridge (U.S. Pat. No. 5,134,825) discloses in FIG. 3 a stamped zee clip 16.

Owens (U.S. Pat. No. 1,292,960) discloses a standing seam roof with one edge 5 having an extending edge to receive nails 6.

Johansson (U.S. Pat. No. 4,514,952) discloses a mounting clip having a tab member 14 mounted on a bridge 18.

Boyd (U.S. Pat. Nos. 4,987,716 and 5,001,881) discloses a standing seam roof with a cleat 32 having a vertical Web section 34, a horizontal cleat edge section 36 and a base section 38 anchored to the substrate.

Carey, II et al. (U.S. Pat. No. 5,259,166) discloses a standing seam roof with an attachment cleat 47.

Haddock (U.S. Pat. No. 5,715,640) in FIG. 16 discloses the use of concealed clips 240 in standing seams.

Notwithstanding the foregoing, there remains a need for a standing seam roof assembly which is simple to install and will not require additional fasteners.

There is also a need for a standing seam roof assembly with inserts that are fabricated from flat metal that are easy to produce and transport.

There is also a need for a standing seam roof assembly that will resist movement due to wind and other forces.

SUMMARY OF THE INVENTION

The present invention is directed to a standing seam roof assembly having a series of panels including a first panel with a first side edge turned substantially vertically upward from the first panel. The assembly also includes a second panel with a second side edge turned substantially vertically upward. The second side edge panel adjoins the first side panel edge. The first panel side edge has a return which is substantially vertical to the first side edge. Likewise, the second panel side edge has a return which is substantially vertical to the second panel side edge.

The panels are supported by a roof structure, such as purlins, and are connected thereto by a plurality of clips which are fastened to the purlins and extend upward between the edges of the panels.

A base insert in one of a number of configurations assists in securing the panels to the purlins or roof structure.

The base insert includes a first section installable beneath the first panel and a second section installable beneath the second panel. The base insert also includes a plurality of upturned tabs so that the first section, the second section, and the tabs may all be fabricated from a single sheet. Once installed, the tabs are juxtaposed between the adjacent side edges of the panels.

A plurality of adhesive beads or pads may be preinstalled on the first section. Likewise, a plurality of preinstalled adhesive beads or pads may be installed on the second section. The adhesive pads may be covered by a peel-off liner for storage and transportation. The tab or tabs are juxtaposed between the side edges and may optionally include a return. Adhesive on the first section adheres to the base of the first panel while adhesive on the second section adheres to the base of the second panel. The first section of the base insert may be at an angle slightly less than perpendicular to the tab. Likewise, the second section of the base insert may be at an angle slightly less than perpendicular to the tab, thereby encouraging adhesion of the base insert to the respective panels. The first section and second section may each be contoured such that the end of each section opposite the tab is substantially perpendicular to the tab, thereby further encouraging adhesion of the base insert to the respective panels.

DETAILED DESCRIPTION OF THE PREFERRED EMBODIMENTS

The embodiments discussed herein are merely illustrative of specific manners in which to make and use the invention and are not to be interpreted as limiting the scope of the instant invention.

While the invention has been described with a certain degree of particularity, it is to be noted that many modifications may be made in the details of the invention's construction and the arrangement of its components without departing from the spirit and scope of this disclosure. It is understood that the invention is not limited to the embodiments set forth herein for purposes of exemplification.

Figure 1:
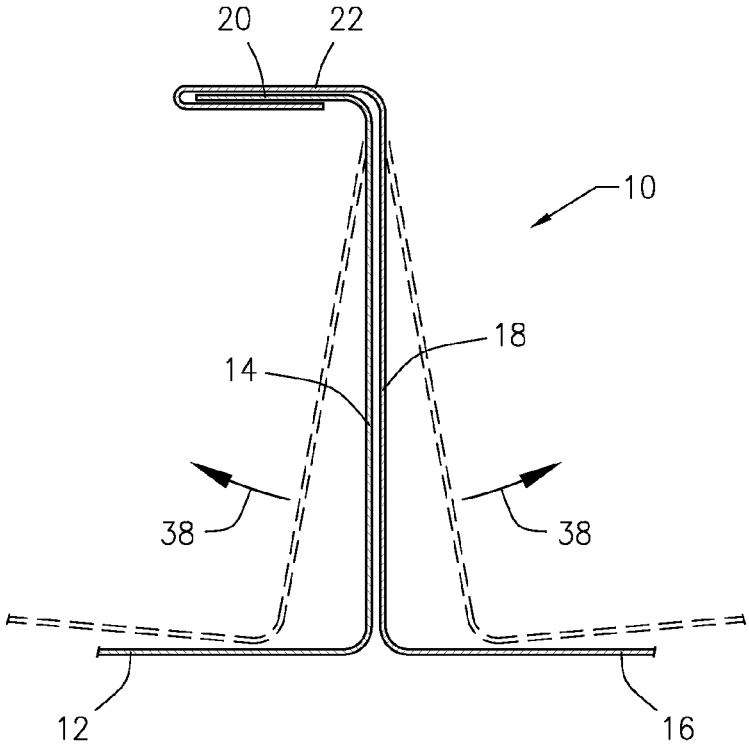
FIG. 1 Prior Art
FIG. 1 illustrates a sectional view of a prior art standing seam roof assembly.

Referring to the drawings in detail, FIG. 1 shows a sectional view of a known, prior art standing seam roof assembly 10 having a first panel 12 with a first side edge 14 running the length of the panel turned substantially vertically upward from the first panel 12. The assembly 10 also includes a second panel 16 with a second side edge 18 running the length of the panel turned substantially vertically upward. The second panel side edge 18 adjoins with the first panel side edge 14.

The first panel side edge 14 has a return 20 which is substantially perpendicular to the side edge 14. Likewise, the second panel side edge 18 has a return 22 which is substantially perpendicular to the side edge 18.

One of the returns may be longer than the other. The returns 20 and 22 are crimped together in various fashions to form a seal to prevent rain, water, ice or particles from passing. A known mechanical crimping tool may be employed.

Figure 2:
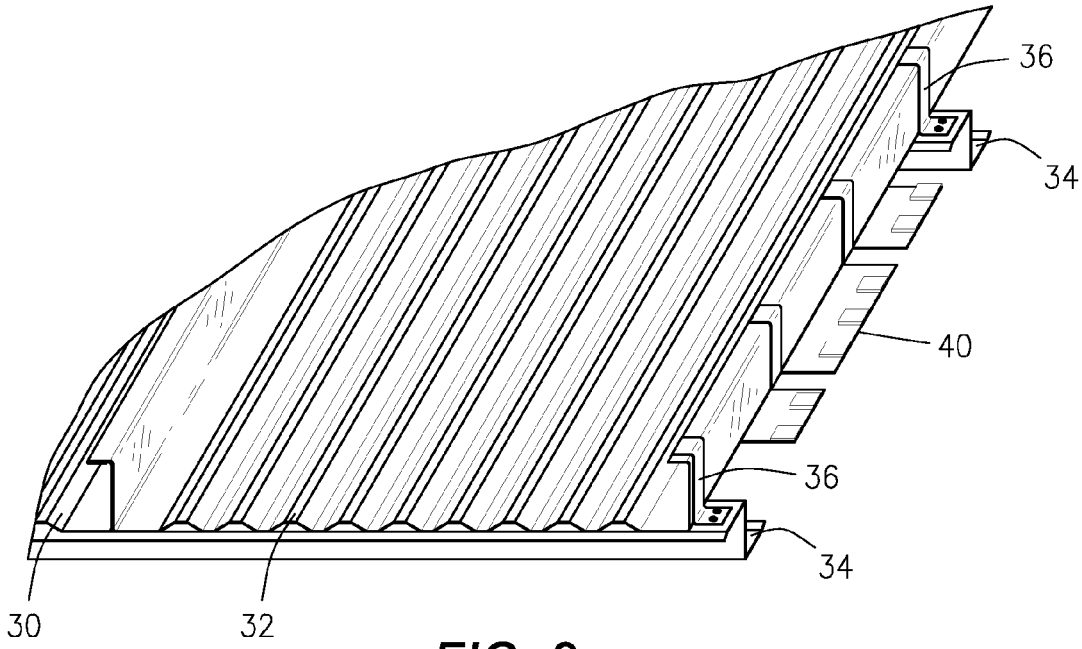
FIG. 2 illustrates a perspective view of an initial preferred embodiment of a pair of panels being installed in a standing seam roof assembly of the present invention.

FIGS. 2 through 7 illustrate the present invention. FIG. 2 is a perspective view of a pair of panels being installed. A series of panels including first panel 30 and second panel 32 adjoin each other and are periodically attached to a structure, such as purlins 34. The purlins 34 are connected to one of the edges of the panels by clips 36. The clips 36 are fastened to the purlins with fasteners. In one non-limiting example, the clips 36 are spaced every five feet along the panel and are attached to the purlins 34.

Figure 7:
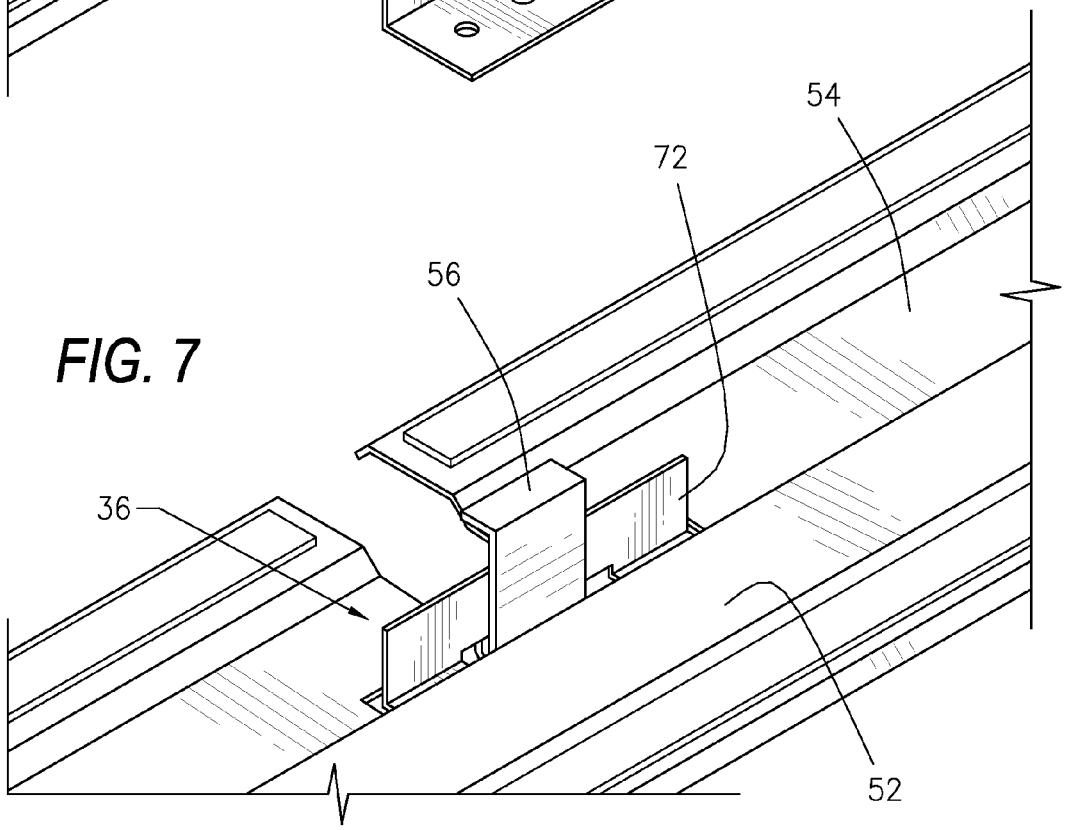
FIG. 7 illustrates a floating clip as assembled for use in the standing seam roof assembly of FIG. 5.
Figure 8:
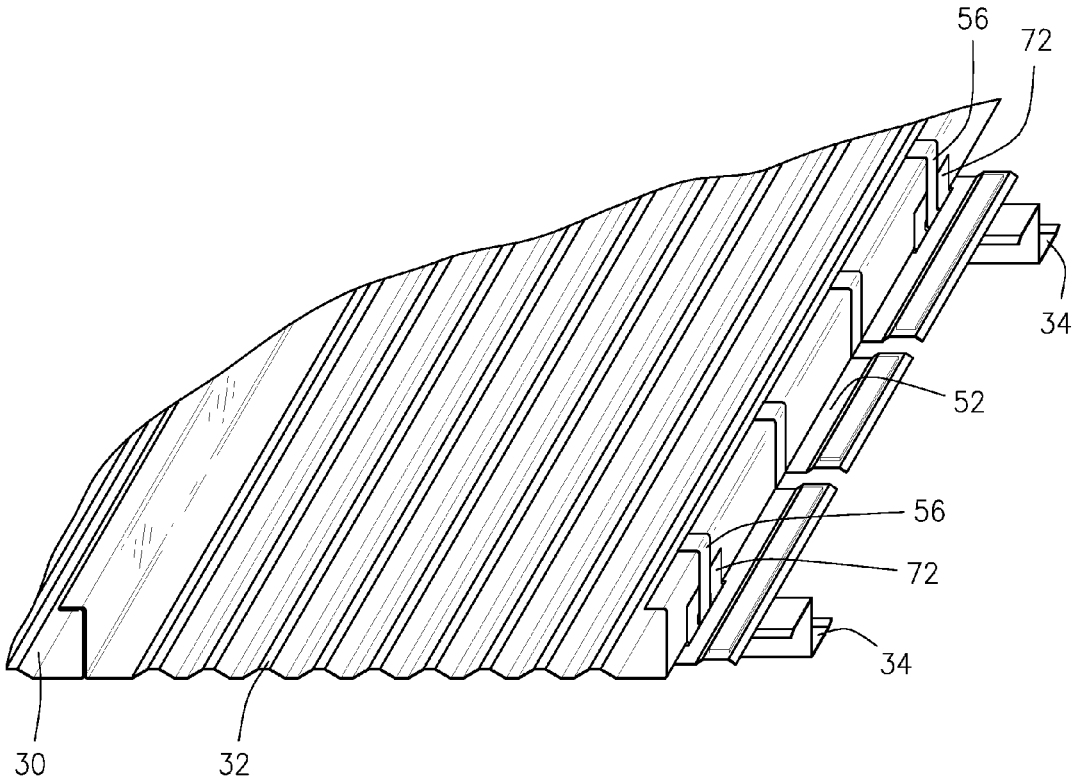
FIG. 8 illustrates a perspective view of an alternate embodiment of a pair of panels including floating clips as shown in FIGS. 6 and 7 being installed.

The clips 36 may be fixed clips or may be floating clips. The floating clips come in a wide variety of configurations, with one design shown in FIGS. 6 and 7. Using floating clips for the clips 36 accommodates expansion and contraction of the roof during thermal movement. The floating clip 36 has a fixed base 72, which may be attached to the purlin 34 by fasteners (not shown). The floating clip has a slot to receive an upturned tab 56 (to be described). The fixed base 72 and the upturned tab 56 fit together, as shown in FIG. 7. Thus, the floating clip 36 may connect the panels 30 and 32 to the purlin 34 but also allows for movement of the panels 30 and 32 relative to the purlin 34.

It will be appreciated that various types of floating clips may be utilized within the spirit and scope of the present invention.

The panels, such as panels 30 and 32, generally lay flat on the purlins. However, a known and persistent engineering dilemma is that wind or other forces may cause the middle of the panels to move upward from vacuum, pulling or sucking forces, thereby causing the seams to tend to separate. Returning to a consideration of FIG. 1, the arrows 38 shows the direction of movement of the panels toward the position shown by dashed lines. A mechanical seam is not strong enough to withstand the pressure/effect and the purlin clips do little to prevent it.

Figure 3:
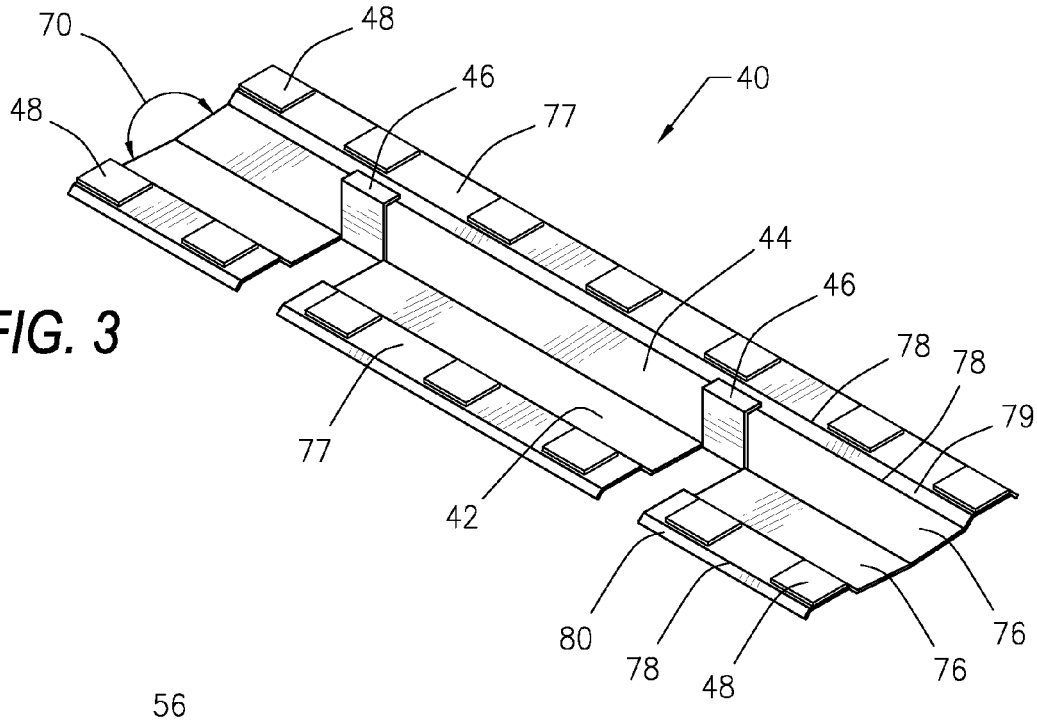
FIG. 3 illustrates a perspective view of a first preferred embodiment.
Figure 4:
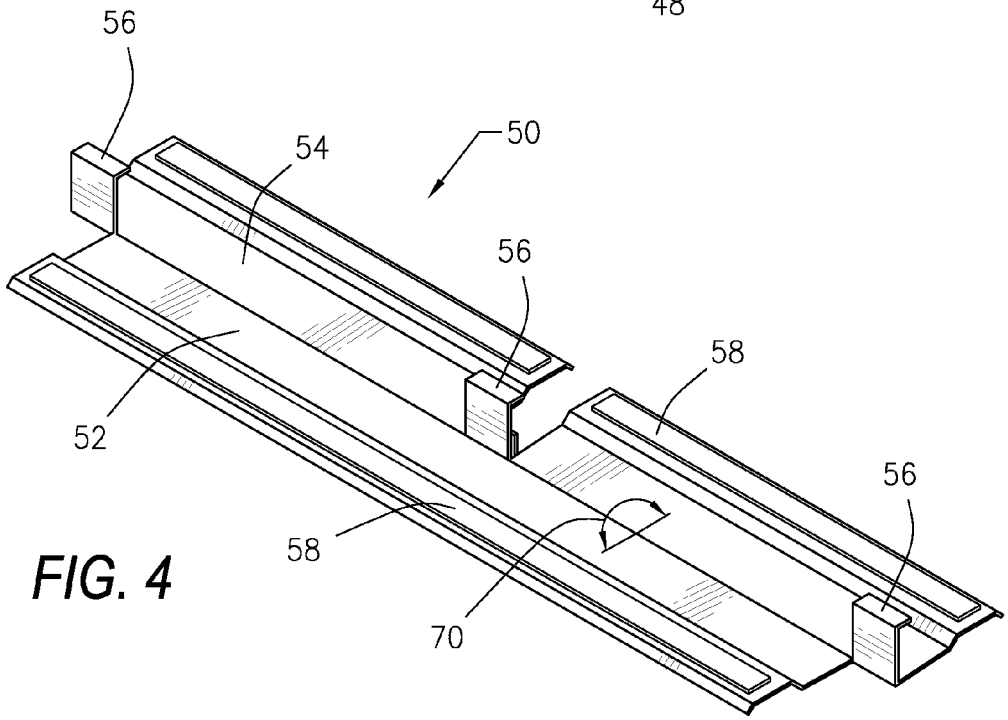
FIG. 4 illustrates a perspective view of a second preferred embodiment of a base insert which is a part of the standing scam roof assembly of the present invention.

The present invention includes a base insert in one of a number of configurations. FIG. 3 illustrates a perspective view of a base insert 40 in a first preferred embodiment while FIG. 4 illustrates a perspective view of a base insert 50 in a second preferred embodiment.

In FIG. 3, the base insert 40 includes a first section 42 installable beneath a first panel, such as panel 30, and a second section 44 installable beneath the second panel, such as panel 32. The base insert 40 includes a plurality of upturned tabs 46 so that the first section 42, the second section 44, and the tabs 46 may all be fabricated from a single piece of flat sheet metal. The tabs 46 are juxtaposed between the adjacent side edges.

A plurality of adhesive beads or pads 48 may be preinstalled on the first section 42. Likewise, a plurality of preinstalled adhesive beads or pads 48 may also be installed on the second section 44. The adhesive pads 48 may be covered by a peel-off liner (not shown) for storage and transportation. The base insert may be shipped flat with the tabs turned up in the field before installation.

A variety of metal joining adhesives may be employed such as, but not limited to, two-part mix or no-mix acrylics, two-part epoxies, polyurethanes, cyanoacrylates, acrylics, and silicones.

In FIG. 4, the base insert 50 includes a first section 52 installable beneath a first panel, such as panel 30, and a second section 54 installable beneath a second panel, such as panel 32. The base insert 50 includes a plurality of upturned tabs 56 so that the first section 52, the second section 54, and the tabs 56 may all be fabricated from a single piece of flat sheet metal. The tabs 56 are juxtaposed between the adjacent side edges.

A continuous line of adhesive 58 may be preinstalled on the first section 52. Likewise, a preinstalled adhesive line 58 may also be installed on the second section 54. The adhesive may be covered by a peel-off liner (not shown) for storage and transportation. The base insert 50 may be shipped in flat condition with the tabs turned up in the field before installation.

Figure 5:
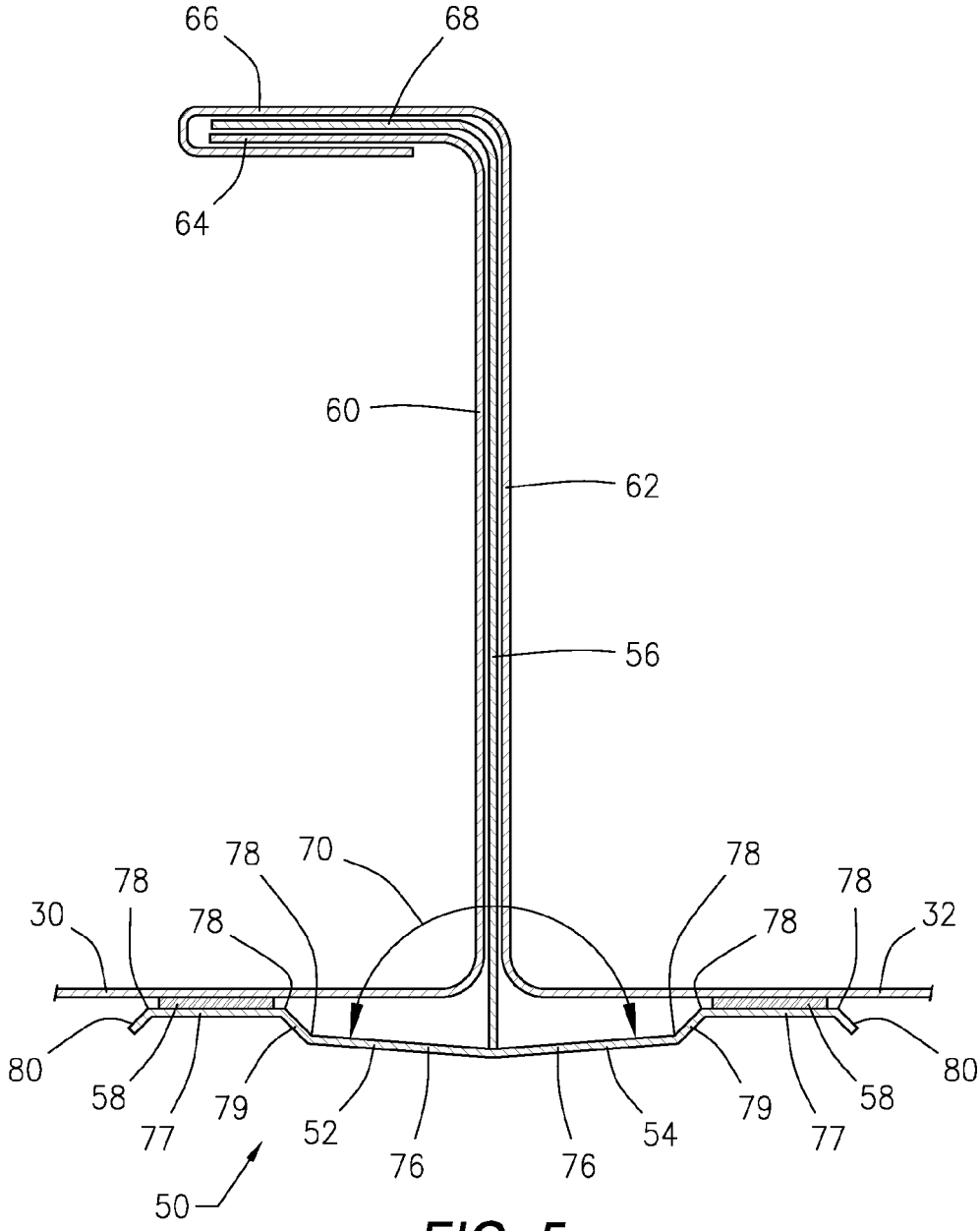
FIG. 5 illustrates a sectional view of a third preferred embodiment of the standing seam roof assembly of the present invention.
Figure 6:
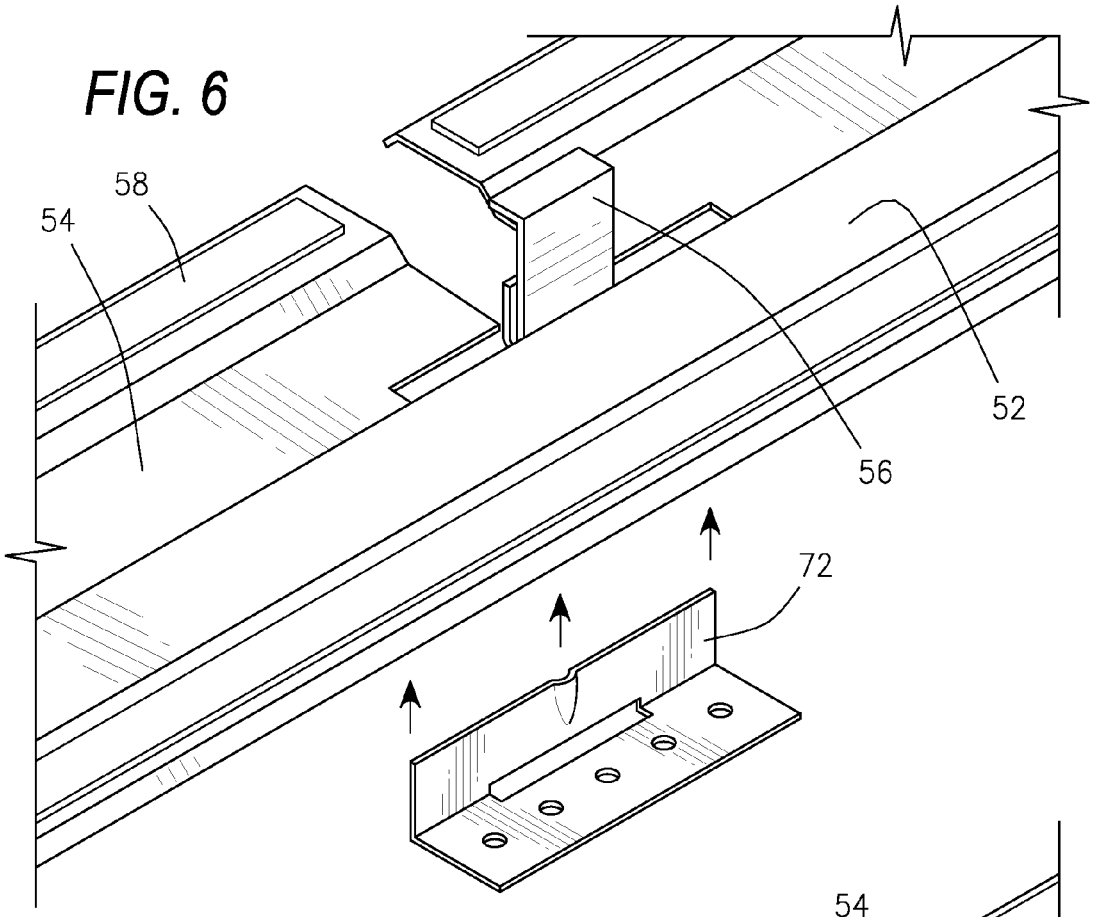
FIG. 6 illustrates the component parts of a floating clip for use in the standing seam roof assembly of FIG. 5.

FIG. 5 illustrates a cross-sectional view of a third preferred embodiment of a roof assembly 10 with the base insert 50 installed thereon constructed in accordance with the present embodiment. The first panel 30 has a first upturned side edge 60 which is substantially perpendicular to the first panel 30. Adjacent second panel 32 has an upstanding edge 62 which is substantially perpendicular to the second panel 32. First side edge 60 has a return 64 substantially perpendicular to the side edge 60. Likewise, side edge 62 has a return 66 which substantially perpendicular to the side edge 62.

The base insert 50 includes a first section 42 beneath the first panel 30. The base insert 50 also includes a second section 44 beneath the second panel 32. The base insert 40 also includes tab 56 which is juxtaposed between side edge 60 and side edge 62. Tab 56 may optionally include a return 68. Adhesive 48 on first section 42 adheres to the base of panel 30. Adhesive 48 on second section 44 adheres to the base of panel 32.

First section 42 and second section 44 may each have an interior portion 76, where interior portion 76 is adjacent to tab 56, and an attachment portion 77, where attachment portion 77 is toward the opposite end of first section 42 and of second section 44 from tab 56. Interior portion 76 of first section 42 may be at an angle between approximately 2 to 7 degrees less than perpendicular to the tab 56 and interior portion 76 of second section 44 may be at an angle between approximately 2 to 7 degrees less than perpendicular to tab 56, as illustrated by arrows 70. First section 42 and second section 44 may each have one or more bends 78 therein located between interior portion 76 and attachment portion 77, such that attachment portion 77 of both section 42 and of section 44 are substantially perpendicular to tab 56 and parallel to the panels, thereby encouraging adhesion of the base insert 50 to the panels. If there is more than one bend 78 in each of first section 42 and second section 44, there may be a middle portion 79 between bends 78. Additionally, there may be an end portion 80 terminating each of first section 42 and second section 44, where the end portion 80 is separated from the attachment portion 77 by a bend 78.

The present invention provides a simple system which can be used with existing standing seam roof assemblies and requires a simple base insert as described herein which may be installed between the clips periodically along the panels.

In order to install the standing seam roof assembly of the present invention in any of the embodiments, the first panel 30 is installed with a first side edge 60 turned vertically upward. A plurality of clips 36 are installed periodically along the first side edge 60 in order to connect the clips to the purlins and, thereby, hold the first panel 30 in place. Thereafter, at least one base insert is installed between each pair of clips with the first section 42 installable under a panel 30 and a plurality of upturned tabs 56 adjacent and aligned with the upturned side edge 60. Thereafter, a second panel 32 is brought to and installed with a side edge 62 turned vertically upward in a position adjoining the first panel side edge 60 with the tabs 56 therebetween. The second section 44 of the base insert is beneath the panel 32 with the adhesive 48 between the second section and the panel.

Finally, the first panel side edge 60 and the second panel side edge 62 are mechanically crimped together, such as with a mechanical crimping tool.

Adhesing the flat bottom of one panel to the flat bottom of the adjoining panel significantly reduces the tendency of the panels to be drawn apart under certain wind load and weather conditions.

Whereas, the present invention has been described in relation to the drawings attached hereto, it should be understood that other and further modifications, apart from those shown or suggested herein, may be made within the spirit and scope of this invention, including, but not limited to, a base insert with no vertical return tabs.

What is claimed is:

1. A standing seam roof assembly for a building structure which assembly comprises:

at least one first panel with a first side edge turned vertically upward, wherein said first panel is supported on said building structure;

at least one second panel with a second side edge turned vertically upward, said second panel side edge adjoining one of said first panel side edges, wherein said second panel is supported on said building structure;

a plurality of clips between said first panel side edge and said second panel side edge, wherein said plurality of clips are floating clips, wherein said floating clips each comprise a fixed base with a slot therethrough, and where said fixed base is fastened to said building structure;

at least one base insert between an adjacent pair of said clips, said base insert having a first section beneath said first panel, joined to a second section beneath said second panel and a plurality of upturned tabs received between said first side edge and said second side edge, wherein said at least one base insert is distinct from said clips and is not connected to said building structure and wherein said slots in said clips receive said upturned tabs; and adhesive on said first section which adheres to said first panel and adhesive on said second section which adheres to said second panel.

2. A standing seam roof assembly as set forth in claim 1 wherein said first panel side edge has a return turned substantially perpendicular to said first panel side edge and wherein said second panel side edge has a return turned substantially perpendicular to said second panel side edge.

3. A standing seam roof assembly as set forth in claim 1 wherein each said at least one first panel has an opposed second side edge turned vertically upward and wherein each said at least one second panel has an opposed first side edge turned vertically upward.

4. A standing seam roof assembly as set forth in claim 1 wherein said at least one base insert includes a peel off liner on said first section adhesive, and a peel off liner on said second section adhesive.

5. A standing seam roof assembly as set forth in claim 1 wherein:

said base insert first section comprises an interior portion, one or more bends, and an attachment portion, where said interior portion is adjacent to said tabs, said interior portion is 2 to 7 degrees less than perpendicular to said tabs, said attachment portion is separated from said interior portion by said one or more bends, and said attachment portion is substantially perpendicular to said tabs and substantially parallel to said first panel; and said base insert second section comprises an interior portion, one or more bends, and an attachment portion, where said interior portion is adjacent to said tabs, said interior portion is 2 to 7 degrees less than perpendicular to said tabs, said attachment portion is separated from said interior portion by said one or more bends, and said attachment portion is substantially perpendicular to said tabs and substantially parallel to said second panel.

6. A standing seam roof assembly as set forth in claim 5 wherein:

said base insert first section further comprises a middle portion between said interior portion and said attachment portion and separated from said interior portion and said attachment portion by said one or more bends; and said base insert second section further comprises a middle portion between said interior portion and said attachment portion and separated from said interior portion and said attachment portion by said one or more bends.

7. A standing seam roof assembly as set forth in claim 1 wherein said first panel and said second panel are each composed of flat sheet metal.

8. A process to install a standing seam roof assembly, which comprises:

installing a first panel with a first side edge turned vertically upward on a structure;

installing a plurality of clips, each said clip having a fixed base with a slot therethrough, periodically along said first side edge to connect said first panel to said structure;

installing at least one base insert between an adjacent pair of said clips, said base insert having a first section installable beneath the said first panel and a second section, and having a plurality of upturned tabs receivable through said slot;

installing a second panel with a side edge turned vertically upward in a position adjoining said first panel side edge wherein said base insert second section is beneath said second panel; and mechanically crimping the side edges together.

9. A process to install a standing seam roof assembly as set forth in claim 8 including adhesively connecting said first section to said first panel and adhesively connecting said second section to said second panel.

10. A process to install a standing seam roof assembly as set forth in claim 8 wherein said structure includes purlins.

* * * * *